US006287210B1

(12) United States Patent
Janusz et al.

(10) Patent No.: US 6,287,210 B1
(45) Date of Patent: Sep. 11, 2001

(54) PROCESS OF FORMING A TWISTED, SPIRALLY GROOVED MEMBER AND THE MEMBER FORMED THEREBY

(75) Inventors: Michael Janusz, Elgin; Michael A. Caccia, Rockford, both of IL (US)

(73) Assignee: Textron Inc., Providence, RI (US)

( * ) Notice: Subject to any disclaimer, the term of this patent is extended or adjusted under 35 U.S.C. 154(b) by 0 days.

(21) Appl. No.: 09/544,905

(22) Filed: Apr. 7, 2000

(51) Int. Cl.[7] ..... B21H 3/02

(52) U.S. Cl. ..... 470/12; 470/16; 72/256; 72/299; 72/371

(58) Field of Search ..... 470/12, 16; 72/299, 72/371, 256, 260, 264, 268, 269

(56) References Cited

U.S. PATENT DOCUMENTS

| | | | | |
|---|---|---|---|---|
| 2,024,070 | * | 12/1935 | Sharp | 470/16 |
| 3,357,205 | * | 12/1967 | Holtkamp | 72/299 |
| 3,455,360 | | 7/1969 | Simons . | |
| 3,683,436 | * | 8/1972 | Reiland | 470/16 |
| 4,779,440 | * | 10/1988 | Cleue et al. | 72/264 |
| 5,074,728 | | 12/1991 | Hsu . | |
| 5,571,349 | * | 11/1996 | Nakuzawa et al. | 72/371 |
| 5,759,003 | | 6/1998 | Greenway et al. . | |
| 5,771,726 | * | 6/1998 | Bibby et al. | 72/299 |

* cited by examiner

*Primary Examiner*—Ed Tolan
(74) *Attorney, Agent, or Firm*—Trexler, Bushnell, Giangiorgi, Blackstone & Marr, Ltd.

(57) ABSTRACT

A novel process of forming a member, process of forming an extruded and axially twisted member, such as a drill, a fastener, a self-drilling/tapping fastener, and the member formed by the process is disclosed. The process includes the steps of: providing a blank; extruding a predetermined shape along at least a section of the blank, thereby forming at least two first portions and at least two portions on the extruded section; forming a head on the end of the blank to define a head and a shank; and axially twisting at least a section of the first and second portions a predetermined amount. As a result of the twisting step, each first portion forms a spiral along the length of the twisted section and each second portion forms a spiral along the length of the twisted section. The first portions alternate with the second portions and each second portion defines a spiral groove for transporting material along the length of the shank. The resulting member can be threaded along all or a portion of the shank.

18 Claims, 4 Drawing Sheets

PROCESS OF FORMING A TWISTED, SPIRALLY GROOVED MEMBER AND THE MEMBER FORMED THEREBY

BACKGROUND OF THE INVENTION

This invention is generally directed to a novel process of forming an extruded and axially twisted member, such as a drill, a fastener, a self-drilling/tapping fastener, and the member formed by the process.

In the prior art, a twisted, grooved member, such as a drill, was formed by cutting away material from a blank to form one or more spiral grooves in the blank. The cutting away of material compromises the grain structure of the resulting member causing the resulting member to be weaker. It would be desirable to improve this process such that an improved member results.

The present invention provides such an improved process with the improved member resulting therefrom. Features and advantages of the process of the present invention will become apparent upon a reading of the attached specification in combination with a study of the drawings.

OBJECTS AND SUMMARY OF THE INVENTION

A general object of the present invention is to provide a novel process of forming an extruded and axially twisted member, and the member formed thereby.

An object of the present invention is to provide a member formed by the novel process of the present invention which is capable of long drilling depths, and very efficient chip removal compared to the prior art, owing this capability to the manufacturing process that allows for multiple spiral grooves, of various cross-sectional geometries.

Another object of the present invention is to provide a member formed by the novel process of the present invention which has improved strength with regard to the grain structure versus the prior art.

A further object of the present invention to provide an axially twisted member formed by the process described herein, having at least one spiral groove, such groove being extended, thereby resulting in a more efficient and increased volume of chip removal from out of the drilled hole than the prior art.

Yet a further object of the present invention is to provide a process for forming a member which can provide various amounts of twist to the member and various patterns on the member.

Briefly, and in accordance with the foregoing, the present invention discloses a novel process of forming a member, such as a drill, a fastener, a self-drilling/tapping fastener, and the member resulting from the process. The process includes the steps of: providing a cylindrical blank; extruding a predetermined shape along at least a section of the blank, thereby forming at least two first portions and at least two portions on the extruded section; forming a head on the end of the blank to define a head and a shank; and axially twisting at least a section of the first and second portions a predetermined amount. As a result of the twisting step, each first portion forms a spiral along the length of the twisted section and each second portion forms a spiral along the length of the twisted section. The first portions alternate with the second portions and each second portion defines a spiral groove for transporting material along the length of the shank. The resulting member can be threaded along all or a portion of the shank.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENT

Figure 1:
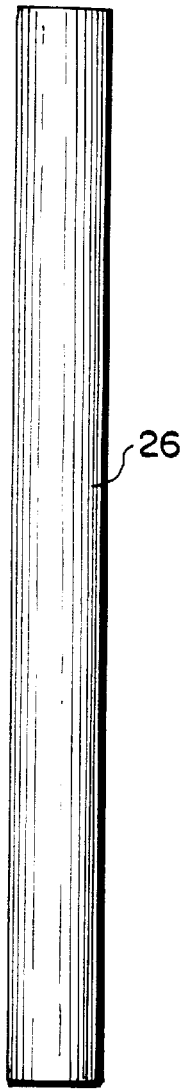
FIGS. 1, 2, 4–6, 9 and 10 are a series of progressions presented as side elevational views of a member being formed using the process which incorporates the features of the invention.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

The present invention provides a process of forming an extruded and axially twisted section 20 of a member 22, such as a drill, a fastener, a self-drilling/tapping fastener, and the member 22 formed by the process. The process utilizes a multi-station heading equipment that forms a head 24 of the member 22 as well as the extruded and axially twisted section 20 of the member 22. This process of manufacture can be used for manufacturing other devices of like geometry and material requirements, such as combination drill-taps, gun drills and the like. The member 22 formed by this process is capable of long drilling depths, and very efficient chip removal compared to the prior art, owing this capability to the manufacturing process that allows for multiple spiral grooves, of various cross-sectional geometries. The process of the present invention is well suited to form a long, spirally grooved, self-drilling fastener for use in heavy gauge steel applications.

The member 22 formed by the process described herein is formed without metal removal. This improves the strength of the member 22 with regard to the grain structure of the member 22. That is, metal removal, as was performed in the prior art, cuts across grain structures and results in weaknesses.

The process of forming the member 22 commences inside the header where a cylindrical wire form is cut into a blank 26, FIG. 1, having a predetermined length and is transferred to the first heading station.

Figure 2:
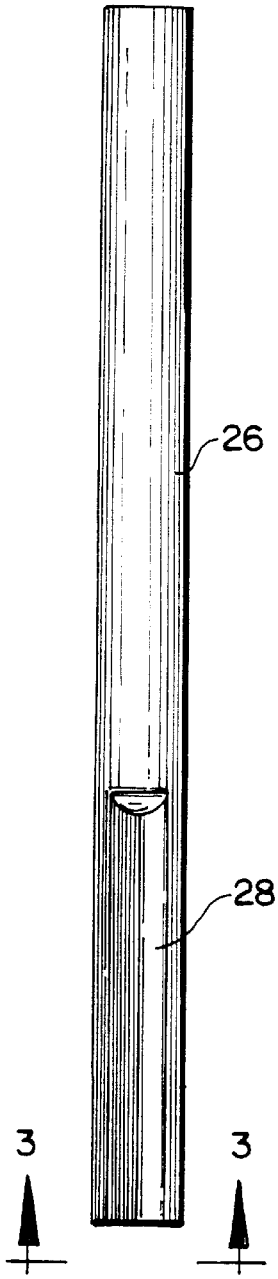

In the first station, at least a section 28 of the blank 26 is extruded into a predetermined shape, FIG. 2. The predetermined shape can take a variety of forms, see FIGS. 3 and 14–17. The shapes shown in FIGS. 3 and 14–17 are representational and other shapes are within the scope of the invention.

Figure 3:
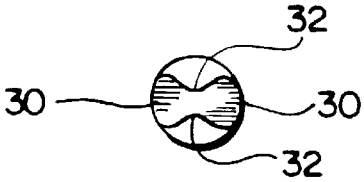
FIG. 3 is an end plan view of the member along line 3—3 of FIG. 2.

For example, as shown in FIG. 3, the section 28 of the blank 26 can be extruded so as to have a cross-sectional shape that has two axially aligned lobes 30 and two axially aligned flutes 32, with the lobes 30 being arranged on the x-axis of the extruded section 28 and the flutes 32 being arranged on the y-axis of the extruded section 28 such that the lobes 30 and the flutes 32 alternate around the circumference of the extruded section 28. The cross-sectional shape is generally uniform and constant along the length of the extruded section 28.

Figure 14:
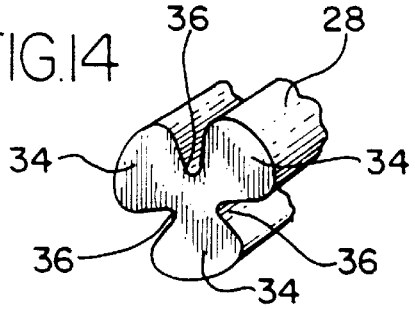
FIGS. 14–17 are partial perspective views of an extruded section which can be formed on the member during the step shown in FIG. 2.

For example, as shown in FIG. 14, the section 28 of the blank 26 can be extruded so as to have a cross-sectional shape that has three lobes 34 and three flutes 26, with the lobes 24 and the flutes 36 alternating around the circumference of the extruded section 28. The cross-sectional shape is generally uniform and constant along the length of the extruded section 28.

Figure 15:
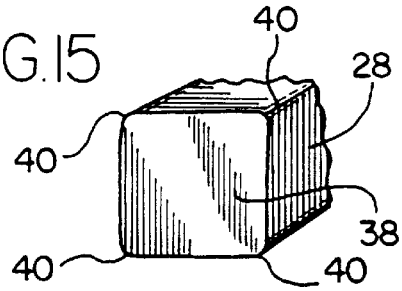

For example, as shown in FIG. 15, the section 28 of the blank 26 can be extruded so as to have a cross-sectional shape that is generally rectilinear, shown as a square 38, with the corners 40 of the square 38 being rounded. The cross-sectional shape is generally uniform and constant along the length of the extruded section 28.

Figure 16:
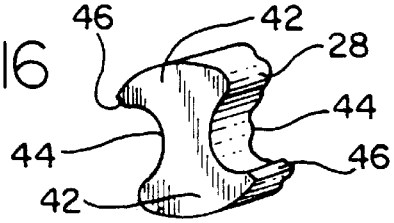

For example, as shown in FIG. 16, the section 28 of the blank 26 can be extruded so as to have a cross-sectional shape that has two axially aligned lobes 42 and two axially aligned flutes 44, with the lobes 42 being arranged on the x-axis of the extruded section 28 and the flutes 44 being arranged on the y-axis of the extruded section 28 such that the lobes 42 and the flutes 44 alternate around the circumference of the extruded section 28. In this shape, one edge of each lobe 42 has a sharpened cutting surface 46 formed thereon. The cross-sectional shape is generally uniform and constant along the length of the extruded section 28.

Figure 17:
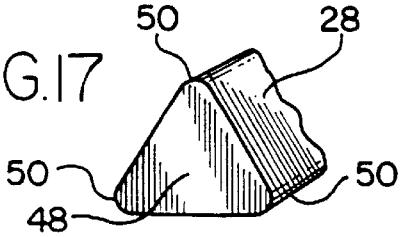

For example, as shown in FIG. 17, the section 28 of the blank 26 can be extruded so as to have a cross-sectional shape that is generally forms a triangle 48, with the corners 50 of the triangle 48 being rounded. The cross-sectional shape is generally uniform and constant along the length of the extruded section 28.

Because the extrusion stresses are relatively low in this operation, the length of the extruded section 28 is restricted only by the length constraints of the heading equipment and in certain materials by their extrusion properties. The shape of FIGS. 2 and 3 is shown in FIGS. 4–10 for purposes of describing the process.

Figure 4:
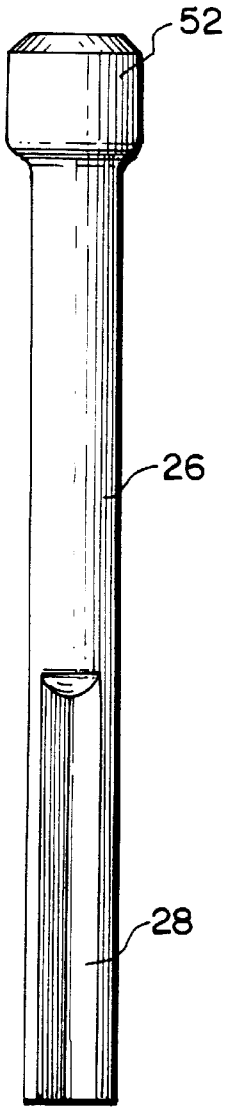
Figure 5:
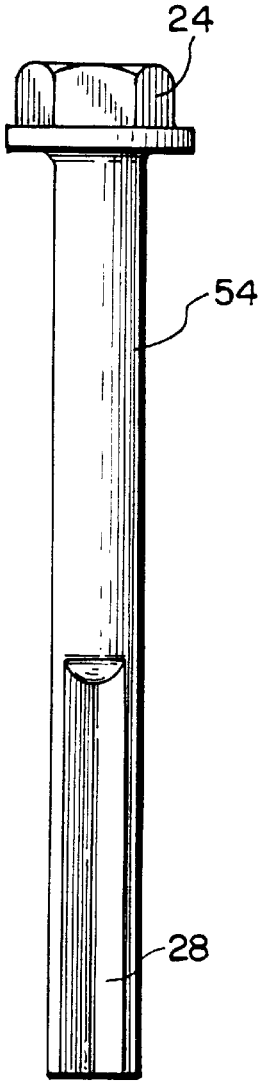

In the second station, a first upset shape 52 is formed on the end of the blank 26 that is not extruded to form a partially completed drive head, FIG. 4. In the third station, the partially completed drive head is finished to a drive head 24, FIG. 5. The drive head 24 can have a variety of shapes formed therein, such as a TORX® recess formed therein, a slot for accommodating a flat-head screwdriver, a generally cross-shape for accommodating a Phillips head screwdriver, or the like. As a result, a head 24 and a shank 54 are defined, with the extruded section 28 being provided on the shank 28. In simple drive heads, instead of forming the drive head in two steps as shown in FIGS. 4 and 5, the drive head is formed to a complete finished shape in one step.

Figure 6:
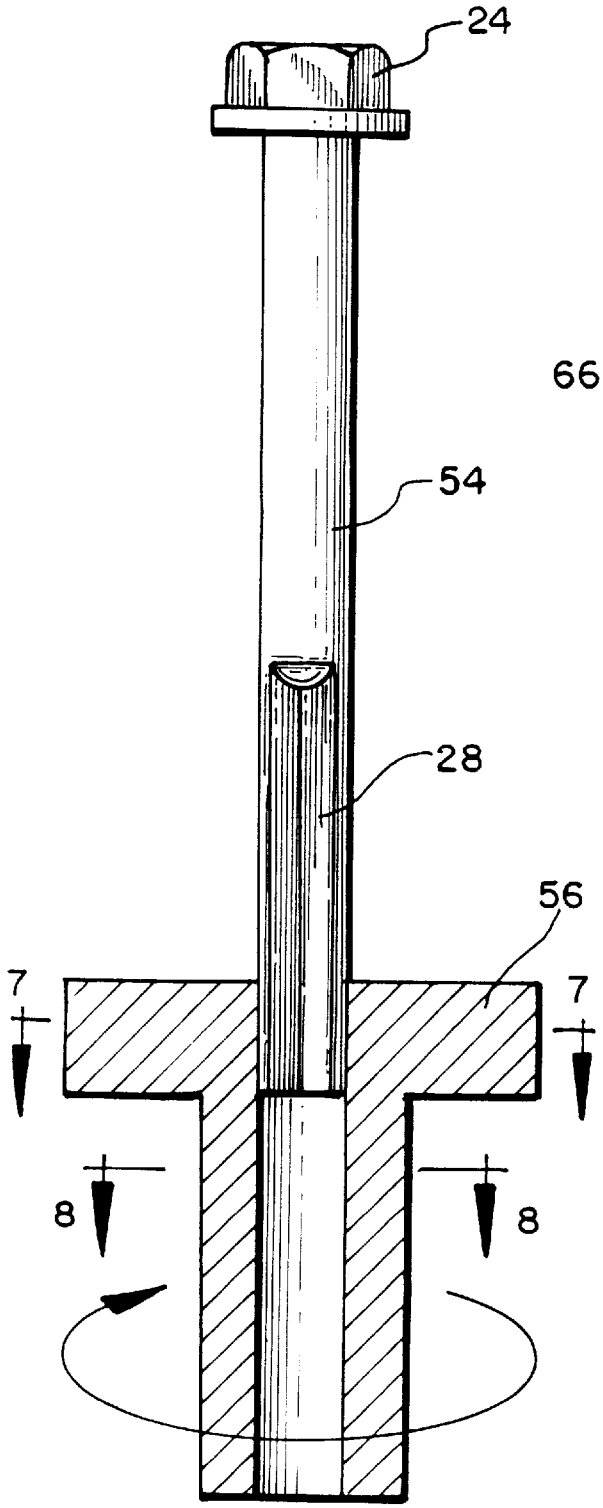
Figure 7:
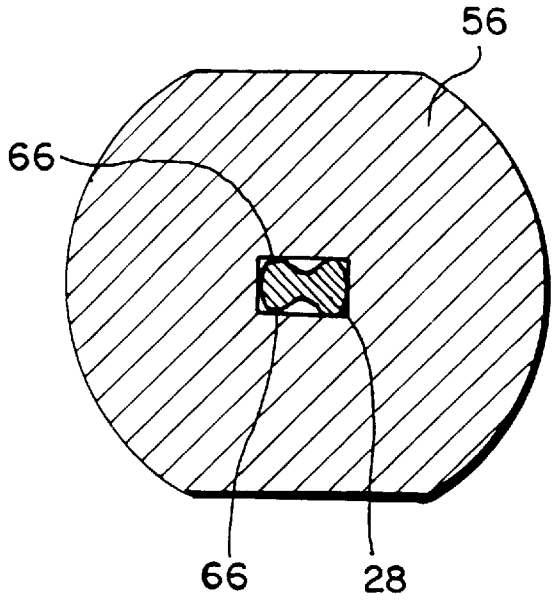
FIG. 7 is a cross-sectional view of the member along line 7—7 of FIG. 6.
Figure 8:
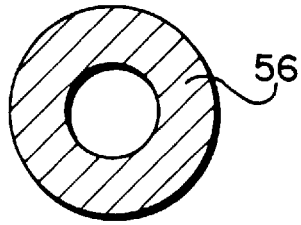
FIG. 8 is a cross-sectional view of the member along line 8—8 of FIG. 6.
Figure 9:
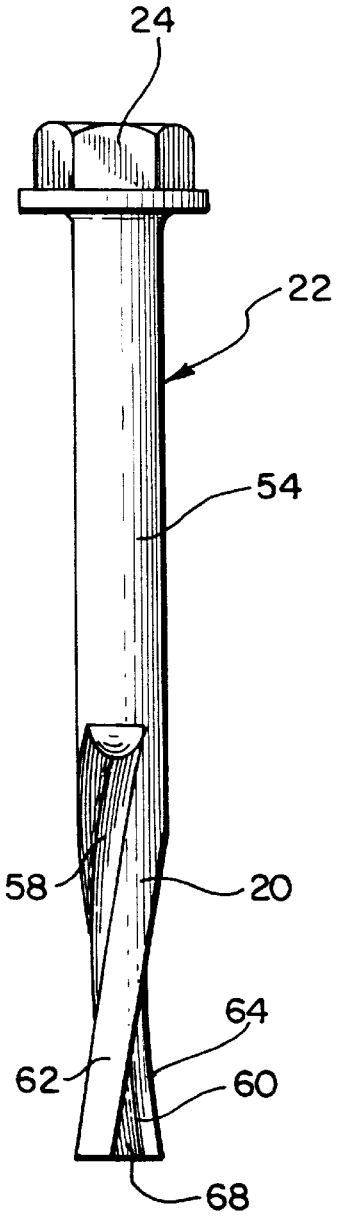

In the fourth station, the extruded section 28 on the shank 54 is axially twisted to a predetermined number of partial or full revolutions such that the material of the shank 54 is cold worked, FIG. 6, to form the twisted section 20. To achieve the rotation, the drive head 24 can be restrained from rotation by suitable means, such as a forming tool or die, and the shank 54 rotated by suitable means, such as a forming tool 56 or die. Alternatively, the shank 54 can be restrained from rotation by suitable means, such as a forming tool or die, and the drive head 24 rotated by suitable means, such as a forming tool or die. Either the head/shank or the forming tool or die can be rotated relative to the other. The forming tool or die merely grips the head 24 or shank 54 and provides for the twisting action. Rotation of the extruded section 28 is constrained on the high side by the travel limits of the heading equipment, and the raw-material extrusion properties. Applicant has successfully achieved rotations of 450°. The extruded section 28 can be twisted in either a clock-wise or counter clock-wise direction to form the twisted section 20.

After twisting, spiral grooves 58, 60 are formed along the length of the twisted section 20. As a result, first portions 62, 64 and second portions 58, 60, which are defined by the formed grooves, are provided, with the second portions 58, 60 being recessed from the first portions 62, 64. The extruded section 28 is not twisted to the extent that the material collapses onto itself such that the lobes 30 would contact each other. That is, after twisting, the grooves 58, 60 are visible along the length of the twisted section 20 and a desired volume is provided along the length of the grooves 58, 60 so that material can be transported along the length of the grooves 58, 60 for chip removal during drilling. Because each groove 58, 60 which is produced is an extended groove, the resulting member 22 provides for a more efficient and increased volume of chip removal from out of the drilled hole. As stated, for purposes of representing how the process is used, the dual lobed and dual fluted shape of FIGS. 2 and 3 is shown in FIGS. 4–10 of the drawings. It is to be understood that the shapes shown in FIGS. 14–17, when twisted, will also result in at least two spiral grooves being formed along the length of the twisted section 20.

Because the extruded section 28 is cold worked to form the twisted section 20, metallurgical benefits, such as improved grain structure, result over the prior art method of cutting material away from the member to form the grooves. The twisting action of the present process tightens the grain structure of the material and increases the strength of the material.

In order to achieve a uniform rotation of the extruded section 28, the extruded section 28 should have at least dual contact points 66 with the restraining or twisting means during rotation.

By controlling relative axial movement between the extruded section 28 and the forming tool 56 or die, as well as controlling the rotated movement between the extruded section 28 and the forming tool 56 or die, the pattern of the twist of the extruded section 28 can be varied to achieve a variety of twisting patterns along the length of the extruded section 28. That is to say, the extruded section 28 can be selectively twisted to provide different twisting portions along the length of the extruded section 28. In this regard, the angle of the resulting grooves can be varied. One or more twisted portions can be separated by untwisted portions or an untwisted tip may be followed by a twisted portion followed by an untwisted, ungrooved portion.

The amount of twist adjacent to the free end of the shank 54 can be controlled by the depth of engagement of the extruded section 28 with the forming tool 56 or die. That is, a substantial depth of engagement will produce an untwisted portion proximate to the free end of the shank 54. Also, the shape of the grooves can be controlled by imparting linear movement to the shank 54 or to the forming tool 56 or die at the same time that relative rotation is taking place during twisting.

A relief 68 is created on the twisted section 20 of the shank 54 as a result of the twisting. The more the shank 54 is twisted, the more relief 68 is formed.

Figure 11:
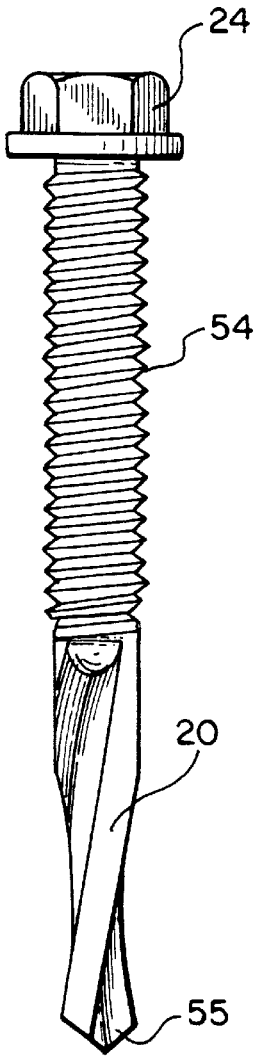
FIGS. 11–13 are side elevational views of a member formed in accordance with the process showing how the member can be threaded.
Figure 12:
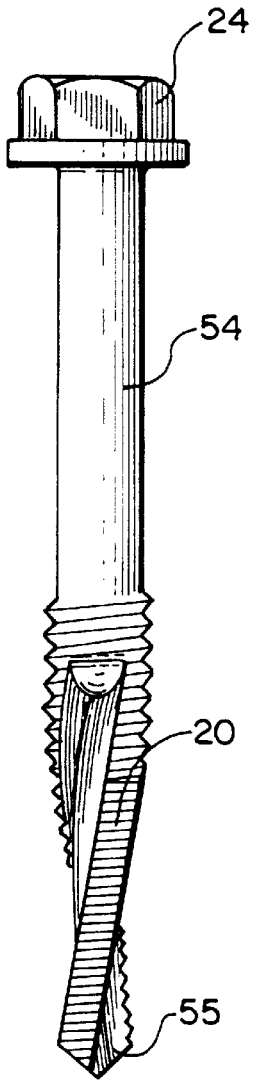
Figure 13:
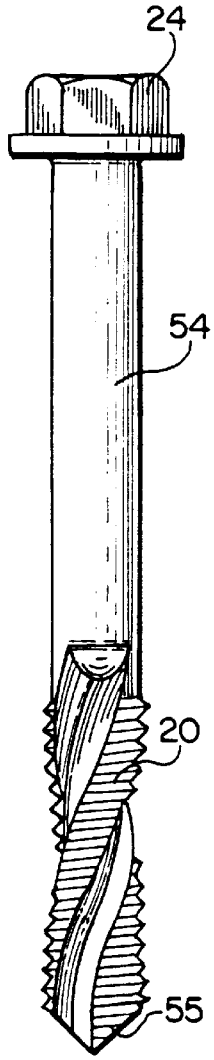

In a fifth station, the entire shank 54 of the member 22 can be thread rolled (not shown), if desired, or predetermined portions of the member 22 can be thread rolled, if desired, to form a threaded fastener, see for example FIGS. 11–13. If the angle of twist of the twisted section 20 is less than 90° and the twisted section 20 is to be threaded, a section of the unextruded portion of the shank 54 must also be threaded, FIG. 12. This is a function of the thread rolling process in the dies. If the degree of twist of the twisted section 20 is less than 90°, the thread will not be properly formed on the twisted section 20 unless threads are formed on a section of the unextruded portion of the shank 54 because the thread rolling process requires at least three points of contact in order to form a proper thread. As such, if the angle of twist is less than 90° and a section of the unextruded portion of the shank 54 is not threaded, the shank 54 will tend to lop in the thread rolling dies. In contrast, if the angle of rotation in the twisted section 20 is greater than or equal to 90°, FIG. 13, at least three points of contact are provided for thread rolling at all times and thread forming on a section of the unextruded portion of the shank 54 is not necessary.

Figure 10:
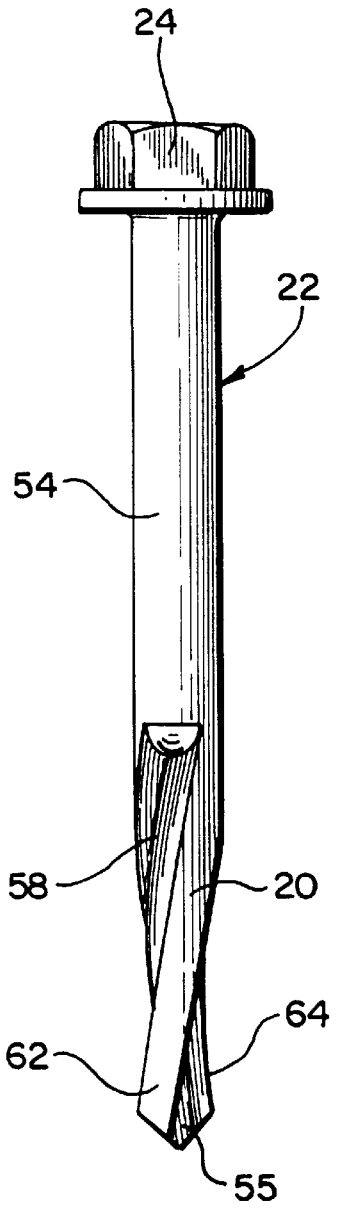

In addition, after twisting, a drill point 55, see FIG. 10, can be formed on the free end of the shank 54 to form a drill tip end of various geometries and constructions. The drill point 55 can be milled, pinched or forged or otherwise fabricated. Other post finishing operations may be applied to the member 22, as required by the intended application.

If the shape of FIG. 16 is used, the cutting edges 46 promote cutting during the drilling process, and facilitates chip removal through the resulting spiral grooves.

It is to be understood that a drill point 55 is not necessary. The member can also be used as a tap to form threads in a pre-drilled hole. In this regard, although the grooves do not provide the function of chip removal, the twisting of the shank provides structural benefits helpful in the tapping process as a result of the tightened grain structure. If the member 22 is used as a self-tapping fastener, cutting edges 46 like that shown in FIG. 16 are required.

While preferred embodiments of the present invention are shown and described, it is envisioned that those skilled in the art may devise various modifications of the present invention without departing from the spirit and scope of the appended claims.

The invention claimed is:

1. A process of forming a member comprising the steps of:

providing a blank having a predetermined length;

extruding a predetermined shape along at least a portion of said blank to define an extruded section including at least two first portions and at least two second portions, said first portions alternating with said second portions;

axially twisting at least a portion of said extruded section a predetermined amount to form a twisted section, wherein each said first portion is twisted to form a spiral along the length of the twisted section and wherein each said second portion is twisted to form a spiral along the length of the twisted section, said second portions defining spiral grooves along said twisted section such that material can be transported along said second portions, said first portions being spaced apart from each other by said second portions such that said first portions do not contact each other.

2. A member formed in accordance with the process as defined in claim 1.

3. A process as defined in claim 1, further including the step of:

forming a drive head on one end of said blank after said extruding step and prior to said twisting step.

4. A member formed in accordance with the process as defined in claim 3.

5. A process as defined in claim 3, further including the step of:

forming a thread on at least a portion of said member.

6. A member formed in accordance with the process as defined in claim 5.

7. A process as defined in claim 2, wherein said drive head is formed by first upsetting an end of said blank and thereafter finishing said drive head.

8. A member formed in accordance with the process as defined in claim 7.

9. A process as defined in claim 1, further including the step of:

forming a thread on a portion of said member, said second portions remaining unthreaded.

10. A member formed in accordance with the process as defined in claim 9.

11. A process as defined in claim 9, wherein during said twisting step, a first section of said blank is twisted and a second section of said blank remains untwisted.

12. A process as defined in claim 11, wherein during said step of forming a thread on a portion of said member, only said first section is threaded.

13. A member formed in accordance with the process as defined in claim 12.

14. A process as defined in claim 11, wherein during said step of forming a thread on a portion of said member, only said second section is threaded.

15. A member formed in accordance with the process as defined in claim 14.

16. A process as defined in claim 11, wherein during said step of forming a thread on a portion of said member, said first and second sections are threaded.

17. A member formed in accordance with the process as defined in claim 16.

18. A member formed in accordance with the process as defined in claim 11.

* * * * *